United States Patent [19]

Squibbs

[11] 4,257,609

[45] Mar. 24, 1981

[54] GAMES AND PUZZLES

[76] Inventor: Robert F. Squibbs, 41, Northwood Gardens, Greenford, London, England

[21] Appl. No.: 12,211

[22] Filed: Feb. 14, 1979

Related U.S. Application Data

[63] Continuation-in-part of Ser. No. 942,682, Sep. 15, 1978, abandoned.

[51] Int. Cl.[3] ..... A63F 9/12

[52] U.S. Cl. ..... 273/241; 273/157 R; 273/160; 273/276; 273/157 A; 273/290

[58] Field of Search ..... 273/156, 157 R, 241, 273/276; 35/27; 46/16

[56] References Cited

U.S. PATENT DOCUMENTS

| | | | |
|---|---|---|---|
| 1,709,660 | 4/1929 | DeBracht | 273/157 R |
| 3,771,795 | 11/1973 | Flanigen | 273/157 R |
| 3,791,649 | 2/1974 | Gold | 273/241 |
| 4,133,538 | 1/1979 | Ambrose | 273/157 R X |

FOREIGN PATENT DOCUMENTS

| | | | |
|---|---|---|---|
| 308886 | 4/1929 | United Kingdom | 273/157 R |
| 675678 | 7/1952 | United Kingdom | 273/157 R |

*Primary Examiner*—Anton O. Oechsle

*Attorney, Agent, or Firm*—Larson, Taylor and Hinds

[57] ABSTRACT

Apparatus for use in performance of a game or puzzle comprises a base and a set of playpieces in the form of cubes or pieces notionally composed of cubes. The base defines a number of recesses each of which is arranged to seat playpieces such that an internal diagonal of each cube is vertical. The base recesses are so ordered with respect to each other that when each seats a playpiece, further playpieces can be seated on the pieces already seated to build up a structure. In one form of the apparatus, the playpieces are cubes carrying parts of a number of pictures on their faces so that when the cubes are correctly stacked the pictures are severally recomposed from their parts.

3 Claims, 15 Drawing Figures

GAMES AND PUZZLES

BACKGROUND OF THE INVENTION

1. Field of the Invention

This invention relates to apparatus for use in the performance of games and puzzles, the present Application being a continuation in part of my Application Ser. No. 942,682 filed Sept. 15, 1978 and now abandoned.

2. Description of the Prior Art

It is well known to use a set of cubes in conjunction with pictures to form a picture puzzle. In such a puzzle a picture is divided into square parts each applied to one face of a respective one of the cubes. Correct positioning of the cubes with the picture carrying face uppermost results in a reconstruction of the original picture. By applying picture parts from five further pictures to the other five faces of each cube, it is possible to arrange for any one of six pictures to be made up by suitable orientation and positioning of the cubes.

Such puzzles are usually made for children using large cubes and simple pictures. The reason for this is partly that since only one picture is being completed at any one time the intellectual appeal and challenge of the puzzle is restricted.

U.S. Pat. No. 3,771,795 teaches a base arranged to support three faces of a large cube such that an internal diagonal of the cube is vertical. The large cube is made up of smaller play piece cubes whose faces are colored to provide a challenge in arranging the cubes to give a particular pattern on the external faces of the large cube.

While positive location of the cubes is achieved by seating them with an internal diagonal vertical, access to the lowermost cubes is very restricted due to the form of base adopted. Furthermore a player is compelled to seat a cube in the lowermost position first.

U.S. Pat. No. 3,791,649 teaches a board for use with flat pieces. The board is recessed with a plurality of cube corner recesses in order to provide three sets of mutually orthogonal playing squares, the purpose of this arrangement being to compress previously known 'three dimensional' games played with a stack of two dimensional boards into more convenient form. However, the use of cubes as play pieces is not considered, the board merely serving as vehicle for planar pieces. Indeed the use of cubes would obscure three recess sides at once which would defeat the whole object of the board.

U.S. Pat. No. 1,709,660 discloses the use of a number of rods of triangular cross-section which stack up on a grooved base to present two flat sloping faces. Picture strips provided on the rods enable pictures to be completed on the sloping faces. The difficulty of the puzzle presented by correct stacking of the rods is not great since the matching of strips of pictures is relatively easy. Furthermore, the rods are not positively located on the stack and tend to become dislodged.

In view of the foregoing, it is an object of the invention to provide apparatus which utilizes as play pieces cubes or pieces notionally composed of cubes and provides a base providing positive location for the play pieces and ease of access to them.

SUMMARY OF THE INVENTION

According to the present invention, there is provided apparatus for use in performance of a game or puzzle, comprising a base and a set of play pieces, the play pieces comprising cubes of substantially equal size, and the base defining a plurality of recesses each arranged to seat a said play piece in such an orientation relative to the base that when the base is horizontal one of the internal diagonals of the play piece is substantially vertical, the base recesses being arranged in a triangular array such that when the recesses each seat a respective one of the play pieces, the seated play pieces together define further recesses which are substantially identical to those formed in the base and in which further of the play pieces can be seated to define together at least one additional further recess, the filling of all said base recesses and all said further recesses defined by seated play pieces resulting in the formation of a three-sided pyramid; in certain embodiments of the invention the play pieces carry picture parts so distributed as to provide picture puzzles of characteristic form, whereas in a further embodiment of the invention the play pieces are marked such as to be capable of use as pieces associated with either one of two players.

BRIEF DESCRIPTION OF THE DRAWINGS

Embodiments of the invention will now be particularly described, by way of example, with reference to the accompanying diagrammatic drawings, in which.

Figure 1:
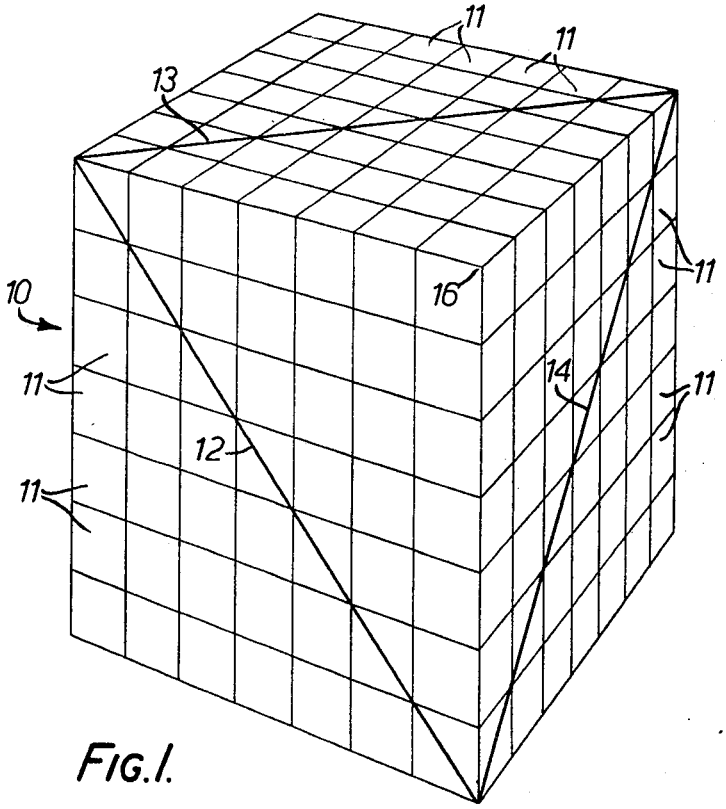
FIG. 1 is a perspective view of a cube, formed by a stack of smaller cubes, illustrating the derivation of a base and set of play piece cubes which together form an embodiment of the invention.
Figure 2:
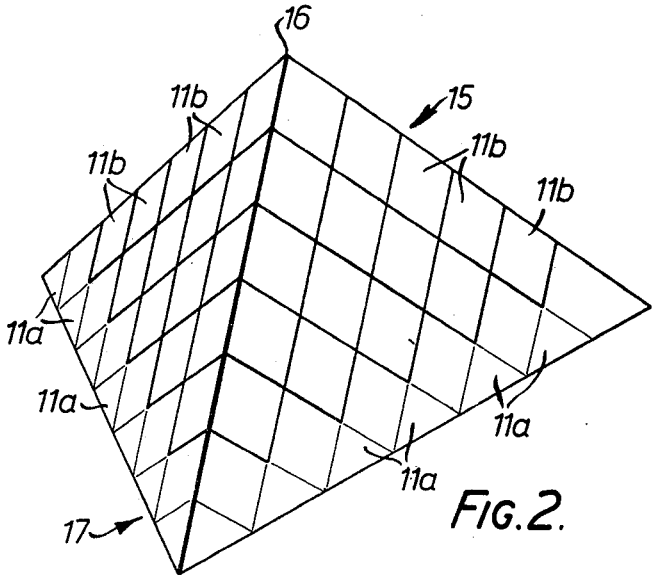
FIG. 2 is a perspective view of the base and play piece cubes whose derivation is illustrated in FIG. 1, the cubes being shown stacked on the base.

Shown in FIG. 1 is a cube 10 comprising a 7 by 7 stack of smaller cubes 11. A cut through the cube 10 in the plane containing the face diagonals 12, 13 and 14 of the cube 10 creates a three sided pyramid 15 (FIG. 2)

whose apex is formed by the corner 16 of the cube 10. The pyramid 15 has a volume equal to one sixth of that of the cube 10.

The base of the pyramid 15 comprises incomplete cubes 11*a* being those cut by the plane containing the diagonals 12, 13 and 14 of the cube 10. The remainder of the pyramid 15 comprises complete cubes 11*b* stacked on the incomplete cubes 11*a* forming the pyramid base; the complete cubes 11*b* of the pyramid 15 will hereinafter be termed play piece cubes 11 and the incomplete cubes 11*a* will be considered as together forming a single entity, that is a base 17 for the play piece cubes 11.

Figure 3:
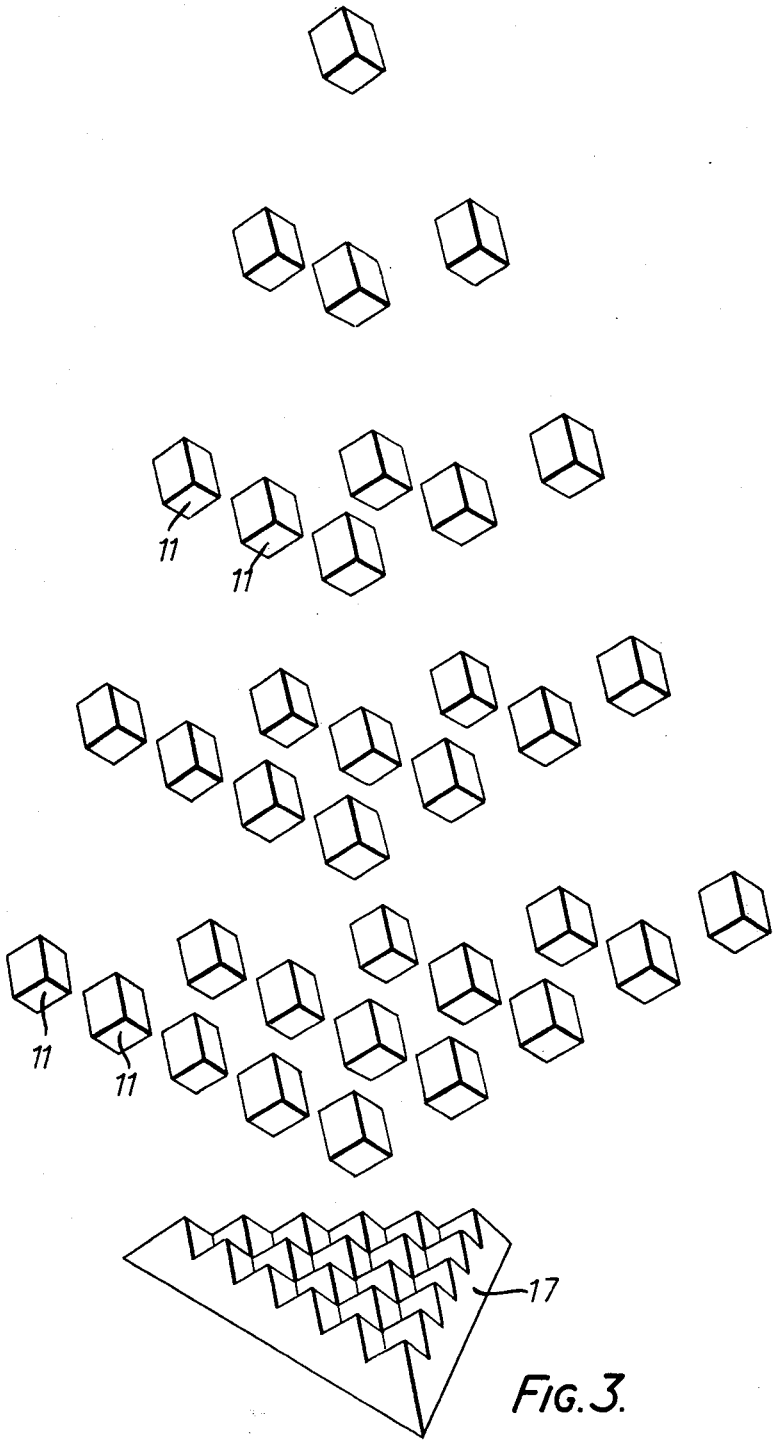
FIG. 3 is an exploded view of the base and play piece cubes shown in FIG. 2.

The stacking arrangement of the play piece cubes 11 on the base 17 may be seen from FIG. 3. The pyramid 15 is built up of five layers of the cubes 11, the layers containing fifteen, ten, six, three and one cubes respectively.

Figure 4:
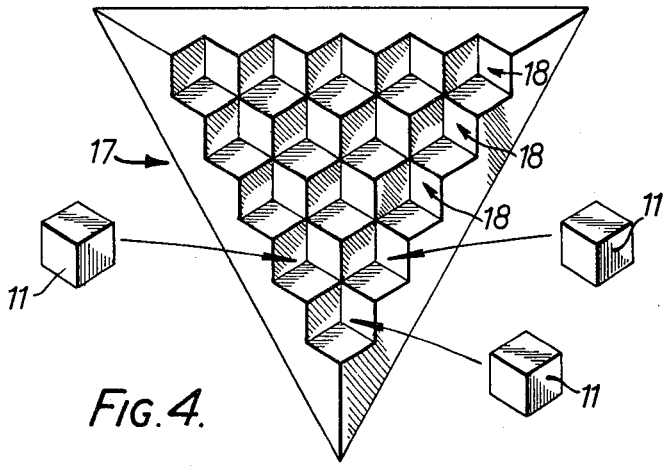
FIG. 4 is a plan view of the base.
Figure 5:
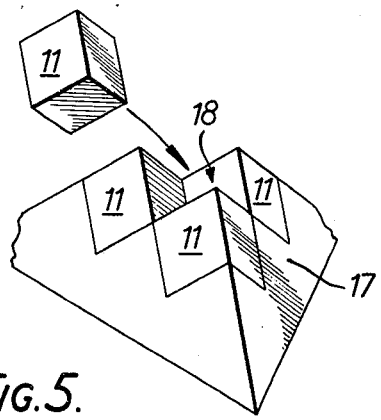
FIG. 5 is a perspective view of a corner portion of the base with three of the play piece cubes located in recesses of the base.

As may be seen from FIG. 4, the base 17 provides fifteen identical recesses 18 each arranged to seat a cube 11 such that an internal diagonal of that cube 11 is vertical when the base 17 is placed on a horizontal surface; in effect each recess 18 acts as a potential energy well for a cube 11 inserted in the recess with the recess being filled by the cube. With cubes 11 inserted in all of the recesses 18 of the base 17, ten further recesses are defined by these cubes 11 in which further cubes 11 can be inserted to build up the pyramid 15 (these further cubes 11 forming six recesses and so on). The formation of a further recess is illustrated in FIG. 5 where three cubes 11 are shown seated in adjacent recesses 18 of the base 17.

Figure 6:
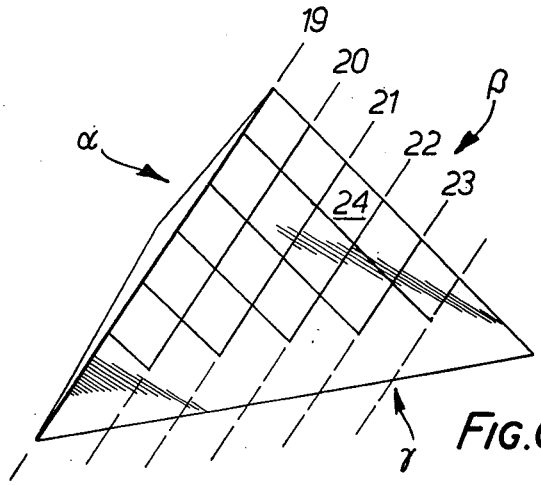
FIG. 6 is a perspective view, from a different angle, of the base and cubes shown in FIG. 2, and illustrating a first form of picture puzzle in accordance with the invention.
Figure 8:
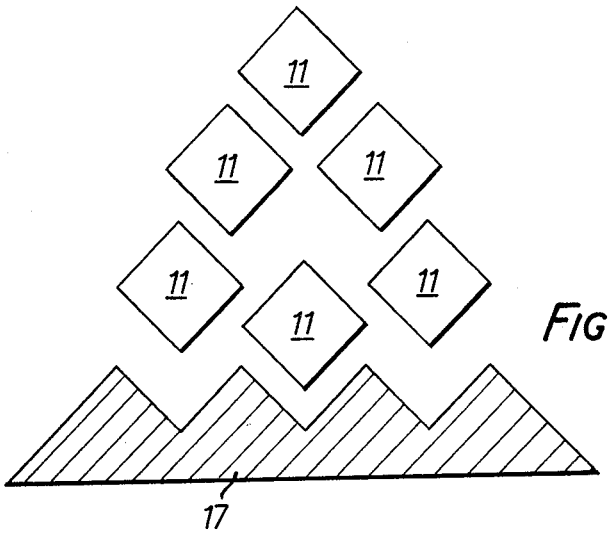
FIG. 8 is a diagram illustrating the make up of a picture in one plane of the stack of cubes shown in FIG. 6.

The pyramid 15 may be considered as being viewable from three main directions, that is, square on to each face of the pyramid 15. These main directions are indicated by the arrows $\alpha$, $\beta$, and $\gamma$ in FIG. 6. Facing each main direction of viewing $\alpha$, $\beta$, and $\gamma$ are five parallel planes formed by the faces of the cubes 11; these five planes 19, 20, 21, 22 and 23 are indicated for the viewing direction $\alpha$ by the dashed lines in FIG. 6. There are thus three sets of five parallel planes in the pyramid 15, that is fifteen planes. The plane 19 is composed of the corresponding face of each of fifteen cubes, and similarly the planes 20, 21, 22 and 23 are composed of one face of each of ten, six, three and one cubes respectively. The composition of plane 21 is illustrated in FIG. 8.

Figure 7:
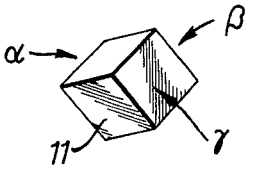
FIG. 7 is a perspective view of one of the cubes shown stacked on the base in FIG. 6.

The surface of each play piece cube 11 forms a part of one plane in each of the viewing directions $\alpha$, $\beta$, and $\gamma$ as indicated in FIG. 7. Thus three faces of each cube 11 form part of the planes viewable in the main directions $\alpha$, $\beta$, and $\gamma$ whereas the other three faces do not, these latter being those which seat in a recess (either formed directly in the base 17 or defined by other cubes 11).

In the first picture puzzle, each of the fifteen planes in the pyramid 15 has an associated picture. Each picture is composed of square parts each associated with the appropriate face of a respective one of the cubes 11 which form the plane associated with the picture concerned. Each of three faces of each cube 11 is thus associated with a part of a respective picture, each of the three pictures associated with a cube 11 facing a different one of the directions of viewing $\alpha$, $\beta$, or $\gamma$. For example, the cube 24 in FIG. 6 has on one of its faces a part of the picture associated with the plane 21 in the viewing direction $\alpha$, on another of its faces a part of the picture associated with the plane 19 in the viewing direction $\beta$, and on a third of its faces a part of the picture associated with the plane 19 in the viewing direction $\gamma$.

If the play piece cubes 11 are unstacked and laid out randomly, a puzzle is created in the correct restacking of the cubes 11 to form again from their component square parts the pictures associated with the fifteen planes of the pyramid 15. The correctness of positioning of any one cube 11 can be triple checked by seeing if the three picture parts associated with that cube 11 fit in with other parts of their corresponding pictures.

As described above, only three faces of each play piece cube 11 are associated with picture parts in the first picture puzzle; it is therefore possible to use the cubes 11 to form another first picture puzzle by associating picture parts with the previously unused faces of the cube 11. The two first picture puzzles formed by the cubes 11 are distinct from each other except that a player has the problem of deciding which three faces of each cube 11 are relevant to the picture puzzle he is trying to solve.

To assist in solution of the first form of picture puzzle, the pictures associated with each main viewing direction $\alpha$, $\beta$, and $\gamma$ may have a common theme, for example the pictures may all be of the same country. Further, the cubes 11 which correctly seat in the recesses 18 of the base 17 can be thus positioned to give the player a start on every picture of the puzzle, or the base 17 can itself be provided with the lowest portion of each picture.

It will be understood that although the base 17 shown in FIGS. 2 to 6 has fifteen recesses, bases of other sizes are also feasible, the base the next size up having twenty-one recesses, that is, a further six recesses along one side.

In a second form of picture puzzle, a triangular base 17 of the form shown in FIG. 4 but provided with only ten recesses 18, is used in conjunction with twenty play piece cubes 11 to enable four different sets of the three outside views presented by a completed pyramid 15 to be built up from picture parts provided on the cube faces. In such a picture puzzle, every face of each of the twenty cubes 11 must carry a picture part since one outside face of the completed pyramid 15 comprises ten cube faces from which it follows that four sets of three full outside face views will take up 120 cube faces, that is, the number of cube faces provided by the twenty cubes 11. The distribution of picture parts from each set of views is important since corner cubes 11 in the completed pyramid 15 require two adjacent picture parts from the set of views being built up and the top cube 11 requires three adjacent picture parts from the same set. A distribution meeting these requirements is one where two cubes 11 each carry two groupings of three picture parts (each of these four groupings being associated with a different view set and the picture parts of each grouping coming from different views of the appropriate view set), and eighteen cubes 11 each carry two single picture parts and two groupings of two picture parts, the single picture parts and the two groupings being from different view sets, and the two picture parts of each grouping coming from different views of the same view set.

In a thrid form of picture puzzle (not shown in the drawings) a master cube 11 is seated centrally in a base (the base 17 shown in FIG. 4 is unsuitable as it has no central recess 18—suitable bases are, for example, those having four or seven recesses 18 along each side). The master cube 11 has on its three exposed faces views of a common subject (for example, Nelson's column, London), the three views being in directions 120° apart.

Around this master cube 11 is to be built up from the puzzle cubes 11 a first layer of surrounding cubes which will form three outer faces each with a view of the common subject (Nelson's column) but from a greater distance than before, each of these more distant views being taken in the same direction as the view on the corresponding face of the master cube 11. Further layers of surrounding cubes can be built up each having progressively more distant views of the common subject. The cubes 11 of the third form of picture puzzle each have either one or two faces with associated parts of the views to be formed (with the exception of the master cube 11 and the cube(s) to be placed vertically above the master cube, these cubes each having three view carrying faces).

Figure 9:
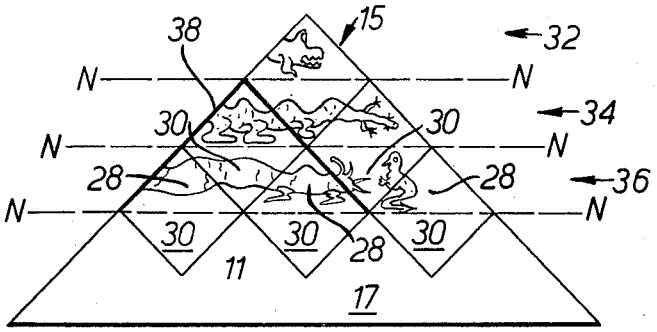
FIG. 9 is a side elevation of another picture puzzle in accordance with the invention.

A somewhat different form of puzzle is shown in FIG. 9 in which a triangular base 17 provided with six recesses 18 is used in conjunction with ten play piece cubes 11 to form a completed pyramid 15. The faces of each cube 11 as seated in the completed pyramid 15 is divided by a notional line N—N (shown dashed in FIG. 9) into upper and lower triangular portions 28 and 30. The upper triangular portions 28 of one layer of cubes 11 interplace with the lower triangular portions 30 of the cubes 11 of the layer above to form a horizontal band; three such horizontal bands 32, 34 and 36 run around the pyramid 15. The object of the picture puzzle is to correctly assemble the cubes 11 such that on the face of the completed pyramid 15 or on the face of any of the whole pyramids which form part of the pyramid 15 (for example, the pyramid 38 outlined in heavy lines in FIG. 9) a run of complete dragons (or other graphic characters) is displayed. A complete dragon will comprise a head portion H, a tail portion T, and a number (including zero) of intermediate body portions B. These dragon portions are provided on respective triangular portions 28 and 30 of the faces of the cubes 11. The cross-overs at the edge of each cube face of the outlines of the head portion H, the tail portion T, and the body portion B are the same for all cubes 11, thus any head portion H will fit any body portion B or tail portion T and so on.

For a complete dragon to be present in the top band 32, a three part dragon (head portion H, body portion B and tail portion T) must be provided around the upper triangular portions 28 of a cube 11; this also applies to the dragons on the corner cubes 11 since each of these cubes 11 will form the top of a complete sub-pyramid (such as the pyramid 38). The distribution of the remaining dragon portions is readily determined by a trail and error method without difficulty.

The dragons represented all have different features which will add to the amusement of the puzzle provided by the task of correctly assembling the cubes 11 to give complete dragons everywhere—the variety of dragons built up (albeit incorrectly) during attempts to sovle the puzzle will keep the player's interest.

Figure 10:
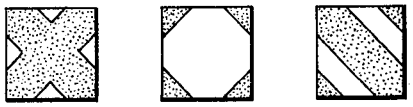
FIG. 10 shows three basic pattern features which can be fitted together to form a pattern.
Figure 11:
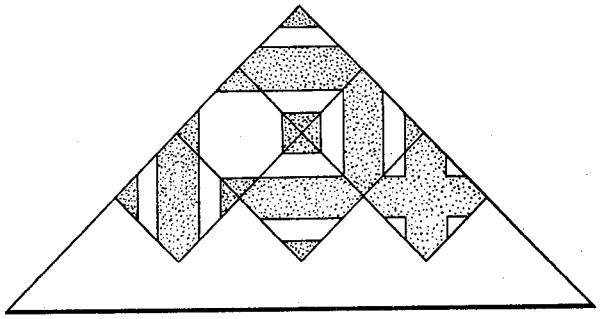
FIG. 11 is a pattern formed on the face of a pyramid built of play piece cubes on the faces of which the pattern features of FIG. 10 have been provided.

The concept of using identical cross-over positions for graphic features represented on different cube faces can be used to enable a wide variety of patterns to be built up on the outside face of a pyramid 15 by providing several basic pattern features each on a plurality of cube faces. Three such basic pattern features which can be fitted together are shown in FIG. 10 and a typical combination of these features can be seen in FIG. 11 for one face of a pyramid 15 formed of ten cubes 11.

In addition to the simple picture puzzles and puzzles with common cube cross-overs already described, a large number of other different puzzles are possible in which information visually displayed on the cube faces interrelates the cubes in a predetermined manner which the player has to derive. For example, it is possible to compile a puzzle by dividing well known quotations between play piece cubes 11. Another alternative is to cut the cubes 11 from a single block of wood, the challenge of the puzzle being then to correctly restack the cubes 11 to give the grain pattern of the original wood block, (a modified form of this concept would be to set swirls of colour in, for example, a block of plastics material which is then divided to form the cubes 11).

Further, the base and play piece cubes can also be used to form a true three dimensional puzzle. For such a puzzle the cubes are made of a transparent material within which are trapped parts of a three dimensional body such that correct stacking of the cubes will result in assembly of the body from its entrapped parts. The body subject of the puzzle can, for example, be a three dimensional thread sculpture, a model, or preserved flowers and plants. It is also possible to form a puzzle from entrapped whirls of colour, bubble patterns, and random arrays of pictures. Such puzzles can be formed by casting the subject matter of the puzzle in transparent material (for example, glass or a plastics material) and subsequently cutting the cast block into cubes (these cubes may then require surface polishing); an alternative method of puzzle fabrication is to cast separately in a cube of transparent material the component parts of the subject matter of the puzzle.

Various games can be played using the described forms of base and play piece cubes.

One such game, which is for two players, is played on a triangular base 17 having, for example, fifteen recesses 18 as shown in FIG. 4. Two sets of cubes 11 are provided, one for each player. The game is played by the players taking turns to place cubes 11 in the recesses 18 in the base 17. The game is complete when all the base recesses 18 have been filled; however to discover who has won the game a complete pyramid 15 must be built up, the winner being the player whose cube 11 forms the top pyramid cube 11 when the following build up rule is followed. This build up rule is that where a recess 18 is defined by two or three cubes 11 of one player then a further cube 11 of that player is placed in the recess. The object of the game is thus to so position one's cubes 11 on the base 17 that in the subsequent build up one's own cubes 11 predominate and end up on top.

To take away the advantage of starting, the player second to play is allowed to dictate where the opening player must place his first cube 11.

For a base 17 having fifteen recesses 18, at least thirty-five cubes 11 will be required and more if one cube has only a single designation and the build up results in more of one players cubes 11 being used than the others. However, if cubes 11 are used which are marked on three faces to designate one player and on three faces to designate the other player, then each cube 11 can be used as a cube 11 of either player simply by orientating the cube 11 as to place the required designation uppermost.

Although the described puzzles and games have all used bases of triangular form this is not necessary and various other forms of bases can be used provided that the base recesses are so positioned that with cubes seated therein, further recesses, similar to the recesses 18, are formed.

Figure 12:
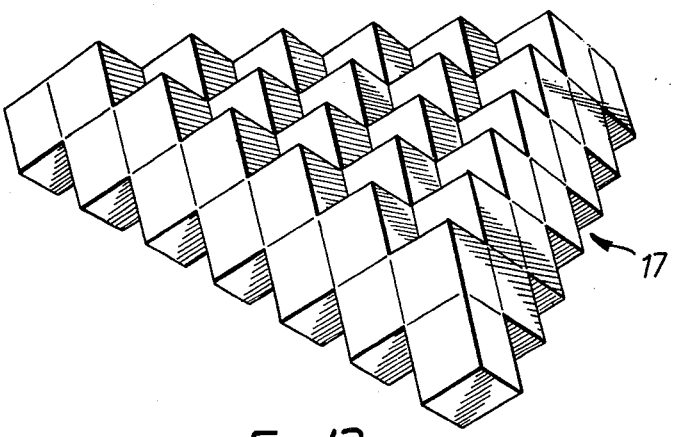
FIG. 12 is a perspective view of a base formed from cubes.

The cubes 11 can, for example, be made of wood, plastics, recycled paper or other low cost non-toxic bulk material. The base 17 can either be moulded from one of the materials used to make the cubes 11 or can be pressed out from sheet material. The base 17 can also be built up from component elements as is illustrated in FIG. 12 in which a base 17 has been fabricated by cementing together cubes 11 or larger elements of a form which can be notionally divided into cubes 11.

Figure 13:
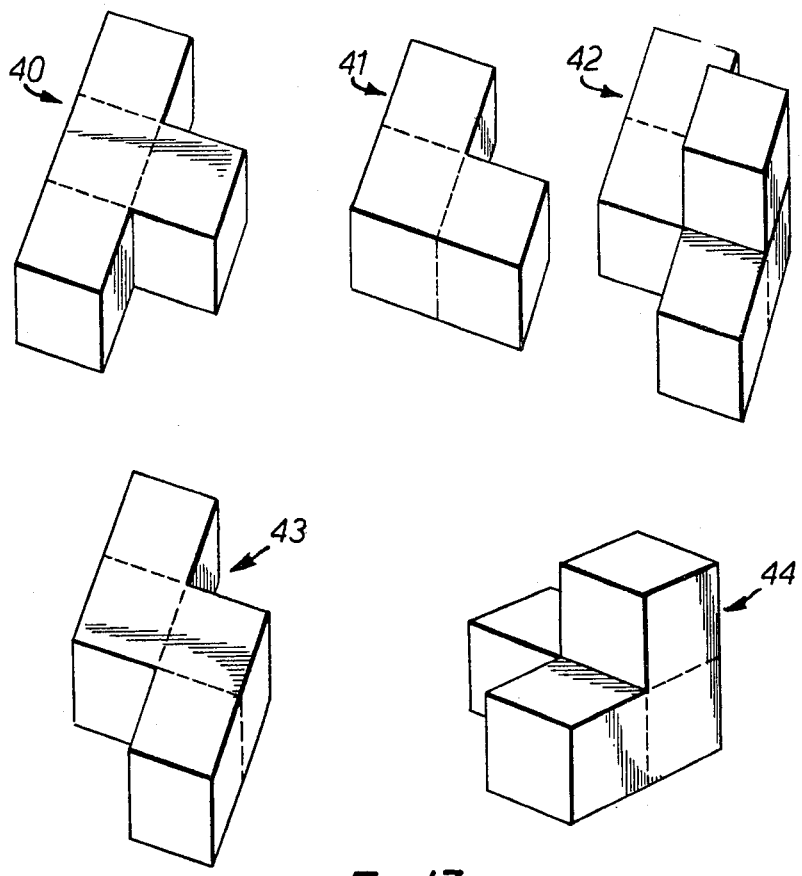
FIG. 13 is a perspective view of five play pieces of a further puzzle of the invention.

All the hereinbefore described embodiments of the invention have used cubes as play pieces. However it is also possible to use play pieces which are each notionally composed of two or more cubes. The play pieces 40 to 44 illustrated in FIG. 13 are of this form as is indicated by the dashed lines. These pieces can be arranged together to seat on a triangular base 17 of the form shown in FIG. 4 but provided with only ten recesses 18, to form a pyramid. The correct arrangement of the play pieces 40 to 44 to form a pyramid without projections is a puzzle having (with the shape of pieces 40 to 44 illustrated in FIG. 13) only one solution (or so it is presently believed). The pieces 40 to 44 could be differently shaped to give a number of correct solutions. Of course, a base 17 with more recesses 18 could be used with a correspondingly larger number of play pieces (or, rather, of notional cubes making up the pieces). A pattern or simple colour scheme could be applied to the play piece faces such that correct arrangement of the play pieces produced a symmetric or otherwise pleasing external appearance to the completed pyramid.

Play pieces similar in form to those shown in FIG. 13 (that is, notionally composed of one or more cubes) can be used together in conjunction with a base 17 provided with recesses 18 seating the cubes or notional cubes to build up various shapes and forms. The distribution of the recesses 18 need not be of the regular form shown in FIG. 4 though preferably the centre spacing of the recesses 18 will be the same. The term 'game or puzzle' as used herein includes the use of the play pieces as building blocks as described above.

Figure 15:
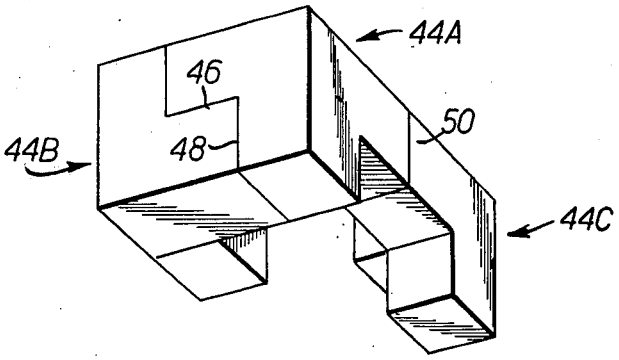
FIG. 15 is a perspective view of a stack of play pieces of the form shown in FIG. 14 but to a smaller scale.
Figure 14:
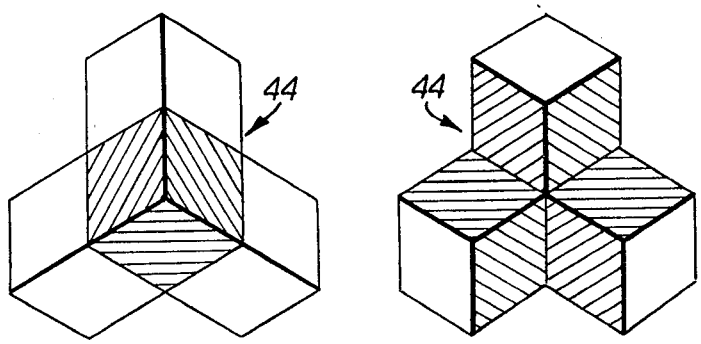
FIG. 14 are perspective views of one play piece of a set of identically shaped pieces of apparatus embodying the invention.

A preferred set of play pieces consists of pieces identical in shape to the play piece 44. Top and bottom views of the play piece 44 are shown in FIG. 14. As can be seen, the play piece 44 is notionally made up of four cubes, three adjacent, mutually perpendicular, faces of one cube each being matched and joined to a face of a respective one of the other cubes. The number of possible orientations of the play piece 44 when seated in a recess 18 or a recess defined by other pieces 44 makes building with the pieces 44 absorbing. Further, the pieces 44 can be seated one upon another in a number of ways other than in a three-sided recess; however, in all cases the pieces 44 forming a seat for a further piece 44 will require to contact the piece to be seated with three mutually perpendicular faces to properly locate that piece. FIG. 15 illustrates one possible seating arrangement for a piece 44A, this piece being supported by faces 46 and 48 of a piece 44B and by a face 50 of a piece 44C. Of course, a play piece 44 can be supported by more than three faces.

A set of play pieces 44 (for example, twenty pieces 44) can be used in performance of a game by dividing the pieces 44 equally between two players. Using a triangular base 17 of the form shown in FIG. 4 but with only six recesses 18, the players take turns to place pieces 44 and so build up a structure. By suitable play, one player may make it impossible for the other player to be able to locate a next piece 44 on the existing structure with three of its faces in contact with three mutually perpendicular faces of the existing structure; in this case the player last to play is deemed the winner.

In a modification of this game, the pieces 44 of one player are coloured white and black as indicated in FIG. 14 (the shaded areas indicate black faces of the piece 44); the pieces of the other player are coloured black and white to compliment the first player's pieces. In playing the game, the first player must place his pieces either to seat in a base recess 18 or to be supported by at least two mutually perpendicular, upwardly facing, black play piece faces of either his own piece or pieces and/or of a piece or pieces of the second player; the number of white supporting faces is irrelevant. Conversely the second player must place his pieces either in a base recess 18 or to be supported by at least two mutually perpendicular, upwardly facing, white play piece faces.

This game can also be adapted to be played by more than two players by arranging for each player's pieces to be coloured as indicated in FIG. 14 but with the faces there indicated black being a colour different for the pieces of each player. Each player must place his pieces either in a base recess 18 or be supported by at least two mutually perpendicular, upwardly facing, play piece faces either coloured white or the colour associated with that player. Of course, the number of base recesses 18 can be varied as can the distribution and numbers of coloured faces of each play piece. Variations on the rules of play piece placement are also possible.

I claim:

1. Apparatus for use in performance of a game or puzzle, comprising a base and a set of play pieces, the play pieces comprising cubes of substantially equal size, and the base defining a plurality of recesses each arranged to seat a said play piece in such an orientation relative to the base that when the base is horizontal one of the internal diagonals of the play piece is substantially vertical; the base recesses being arranged in a triangular array such that when the recesses each seat a respective one of the play pieces, the seated play pieces together define further recesses which are substantially identical to those formed in the base and in which further of the play pieces can be seated to define together at least one additional further recess, the filling of all said base recesses and all said further recesses defined by seated play pieces resulting in the formation of a three-sided pyramid; and each said play piece being provided with three picture parts on respective mutually perpendicular faces thereof, the arrangement of the picture parts being such that correct stacking of the play pieces to form said pyramid results in three sets of completed pictures, each set being composed of a picture on a respective external face of the pyramid and pictures on respective internal pyramid planes parallel to said external face.

2. Apparatus for use in performance of a game or puzzle, comprising a base and a set of play pieces constituted by twenty cubes of substantially equal size, the base being formed with ten recesses each arranged to seat a said play piece in such an orientation relative to the base that when the base is horizontal one of the internal diagonals of the play piece is substantially vertical; the ten base recesses being arranged in a triangular array composed of four rows of four, three, two and one recesses respectively, and said recesses being so mutually disposed that when the recesses each seat a respective one of the play pieces, the seated play pieces together define further recesses which are substantially identical to those formed in the base and in which further of the play pieces can be seated to define together at least one additional further recess, the filling of all said base recesses and all said further recesses defined by seated play pieces resulting in the formation of a three-sided pyramid; each face of each play piece being provided with a respective one of one hundred and twenty picture parts made up of ten picture parts from each of twelve pictures, the distribution of the picture parts between the said play piece faces being such that the play pieces can be stacked in four ways to form said pyramid with each way presenting a different three of said twelve pictures on the external faces of the pyramid.

3. Apparatus for use in performance of a game or puzzle, comprising a base and a set of play pieces, the play pieces comprising cubes of substantially equal size, and the base defining a plurality of recesses each arranged to seat a said play piece in such an orientation relative to the base that when the base is horizontal one of the internal diagonals of the play piece is substantially vertical; the base recesses being arranged in a triangular array such that when the recesses each seat a respective one of the play pieces, the seated play pieces together define further recesses which are substantially identical to those formed in the base and in which further of the play pieces can be seated to define together at least one additional further recess, the filling of all said base recesses and all said further recesses defined by seated play pieces resulting in the formation of a three-sided pyramid; each play piece cube having three mutually perpendicular faces marked with a first common identity and its other three faces marked with a second common identity whereby each piece can function as a piece of one or other of two players depending on which three faces with common identity face uppermost when the piece is seated in a said recess.

* * * * *